United States Patent [19]

Christoffel, Jr.

[11] Patent Number: 4,557,443

[45] Date of Patent: Dec. 10, 1985

[54] POSITIONALLY ADJUSTABLE KITE STRUT CONNECTOR

[75] Inventor: Julius M. Christoffel, Jr., Houston, Tex.

[73] Assignee: Gayla Industries, Inc., Houston, Tex.

[21] Appl. No.: 527,420

[22] Filed: Aug. 29, 1983

[51] Int. Cl.[4] ..... B64C 31/06
[52] U.S. Cl. ..... 244/153 R
[58] Field of Search ..... 244/153 R, 155 R

[56] References Cited

U.S. PATENT DOCUMENTS

| | | | |
|---|---|---|---|
| 4,133,500 | 1/1979 | Chapman | 244/153 R |
| 4,277,040 | 7/1981 | Christoffel, Jr. | 244/153 R |
| 4,286,762 | 9/1981 | Prouty | 244/153 R |
| 4,368,861 | 1/1983 | Ohasto | 244/153 R |

*Primary Examiner*—Galen L. Barefoot
*Attorney, Agent, or Firm*—Arnold, White & Durkee

[57] ABSTRACT

A positionally adjustable strut connector for a kite is disclosed in which the connector has a first body member hingedly connected to a second body member. One body member is adapted to receive a wing strut while the other member is adapted to receive the cross or bracing strut.

6 Claims, 3 Drawing Figures

POSITIONALLY ADJUSTABLE KITE STRUT CONNECTOR

BACKGROUND OF THE INVENTION

This invention relates generally to kites, and more particularly to positionally adjustable strut connectors for kites.

There are various kite structures which are manufactured, stored, shipped and used with relative ease. Kites of this nature usually have a detachable strut which is used as a brace between the struts which support the leading edges of the wings of the kite. Usually the ends of the bracing strut are placed in connectors which attach to the respective wing struts.

U.S. Pat. No. 3,534,932, for example, discloses and illustrates strut connectors or brackets which have been used to attach the bracing or cross strut to the wing struts. U.S. Pat. No. 4,277,040 likewise discloses a kite strut connector which is used to connect the cross and wing struts. U.S. Pat. Nos. 3,963,200 and 4,072,284 illustrate other types of strut connectors.

It is believed that all strut connectors which have been used heretofor are deficient in that they can only be used for a specific kite which has a particular angular relationship between its leading edges. For example, and for purposes of illustration only, if the kite illustrated in FIG. 1 were placed on a flat surface and if planes perpendicular to that surface and coincident with the longitudinal axes of the wing struts were extended until they met, an angle B having a specific dimension would be formed for a given kite. If a manufacturer desired to produce a kite having either a larger or smaller angle B then a different strut connector would be needed since all previous used kite connectors have had a fixed angular relationship between the wing strut holder and cross strut holder. Hence, for each kite having a different angle B a manufacturer has been required to provide a different strut connector. This has forced the manufacturer to invest relatively large sums of money for the various molds which need to be used to produce the different strut connectors.

It would be desirable, consequently, to provide a strut connector which could be universally used with all kites irrespective of the angle B of the kite.

SUMMARY OF THE INVENTION

The invention provides for a positionally adjustable strut connector. The strut connector may be used with any kite irrespective of the angular relationship of the leading edges of the wings. This connector, therefore, eliminates the requirement of having a different type of connector for each kite having a different angular relationship between the leading edges of its wings.

The adjustable strut connector of the invention may include a first body member adapted to receive one of the wing-struts, and a second body member adapted to receive one end of the cross-strut. The first and second body members are hingedly connected to each other and can be moved relative to each other. This permits the selective alteration of the angle between the longitudinal axis of the cross-strut receiving member and the longitudinal axis of the wing-strut receiving member.

The first and second body members of the adjustable strut connector may receive struts having any type of cross section including circular, rectangular and square. The first and second body members of the strut connector can have various configurations and cross sections.

The first and second body members can be hingedly connected in any suitable manner, and can be disposed in any suitable manner on the wing-struts.

BRIEF DESCRIPTION OF THE DRAWINGS

The invention will further be described with reference to the accompanying drawings which illustrate a particular embodiment of a positionally adjustable strut connector in accordance with the present invention, where like members bear like reference numerals and wherein.

DESCRIPTION OF THE PREFERRED EMBODIMENT

Figure 1:
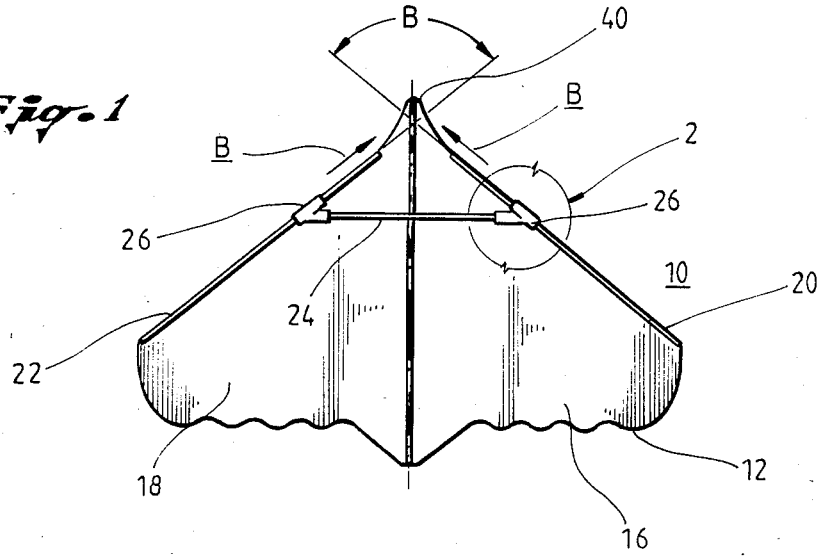
FIG. 1 is a planar view of a kite having adjustable strut connectors according to the present invention.

Referring now to the drawings, and in particular to FIG. 1, there is shown in planar view a kite 10 having a body 12. The body 12 includes a flat material symmetrically disposed about a centerline 14. The centerline 14 extends generally fore and aft of the body 12 and divides the body into wing portions 16 and 18. The wing portions 16 and 18 include leading edges that are secured to wing-struts 20 and 22, respectively.

A cross-strut 24 has one end connected to the wing-strut 20, and another end connected to the wing-strut 22. Each end of the cross-strut 24 is connected to the wing-struts 20, 22 by a positionally adjustable strut connector 26. The connector is preferably affixed to the wing struts by metal staples.

Figure 2:
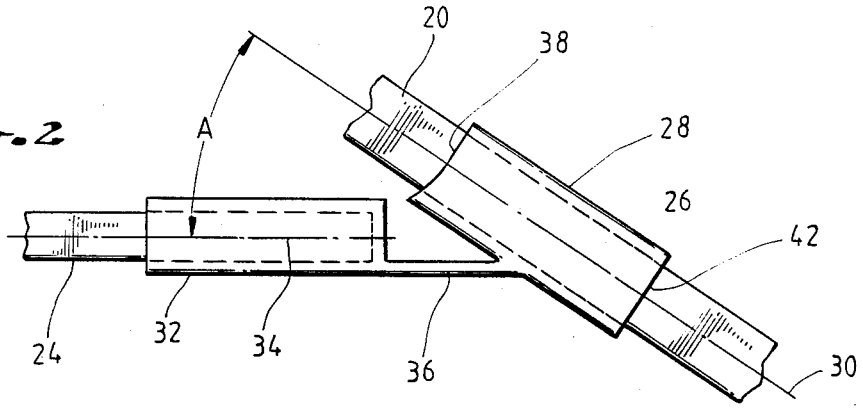
FIG. 2 is a planar view of the adjustable strut connector illustrated in FIG. 1.

Referring now to FIG. 2, the strut connector 26 includes a first body member 28 disposed about a longitudinal axis 30. The first body member 28 is adapted to receive the wing-strut 20. The body member 26 accommodates the wing-strut 20 such that the longitudinal axis of the wing-strut 20 coincides with the longitudinal axis 30.

The strut connector 26 further includes a second body member 32 disposed about a longitudinal axis 34. The second body member 32 is adapted to receive one end of the cross-strut 24. When so received, the longitudinal axis of the cross-strut 24 coincides with the longitudinal axis 34.

The first and second body members 28 and 32 are hingedly connected by hinge structure 36. The hinge structure 36 permits the first and second body members 28 and 32 to be selectively moved relative to each other to selectively alter the angle A between the longitudinal axes 30 and 34. In the embodiment illustrated in FIG. 2, the hinge stucture 36 is an integral part of the first and second body members 28 and 32. In an alternate embodiment (not illustrated), the hinge structure includes a hinge member fixedly connected to the first and second body members. As will be apparent to those skilled in the art, any suitable hinge structure may be used.

Although the hinge which is illustrated in FIG. 2 is attached to the middle of the side of the body member 28, it should be understood that the respective sides of the hinge may be attached along any point of body member 28 and body member 32. For example, one end of the hinge could be attached at the bottom of member 28 and the other end of the hinge could be attached at the top of body member 32, instead of the bottom as illustrated in FIG. 2.

In operation, the positionally adjustable strut connectors 26 is disposed at any suitable location along the wing-struts 20 and 22, as illustrated in FIG. 1. A cross-strut 24 having a particular length is then accommodated by the strut connectors 26, thereby establishing the angular relationship between the cross-strut 24 and each of the wing-struts 20 and 22. The separation between the wing-struts 20 and 22 is established by the length of the cross-strut 24.

Figure 3:
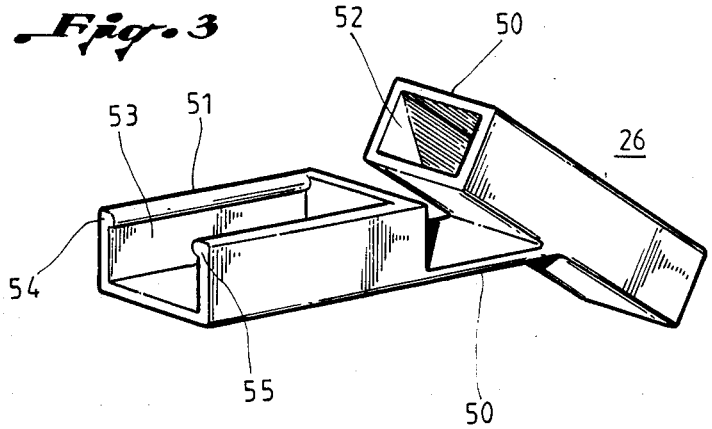
FIG. 3 is a perspective view of an alternative embodiment of the adjustment strut connector of this invention.

An alternative embodiment of the adjustable strut connector is illustrated in FIG. 3. The connector includes a first member 50 and a second member 51. The first member 50 has a central opening having a rectangular cross-section through which wing strut 20 maybe inserted. The second body member 51 has an open face through which cross strut 24 maybe placed. Beads 54 and 55 extend along the entirety of the edges of the open face of body member 51. These beads provide engaging means to maintain the cross strut 24 securely within body member 51.

Although the beads are illustrated as extending along the entire length of the body member 51, it should be apparent that they may extend along a substantial portion but not all of the length of the open face 53.

The structure of second body member 51 is similar to that disclosed in U.S. Pat. No. 4,277,040, which is incorporated herein by reference.

The two body members 50 and 51 are hingedly connected to hinge structure 56. Structure 56 may connect body members 50 and 51 in a fashion similar to hinge member 36 illustrated in FIG. 2. The hinge may be an integral part of the body members or it may be connected to the body members in any suitable fashion.

The positionally adjustable strut connector of this invention may be suitably cast or molded from various rubber or plastic materials such as high density polyethylene, nylon or synthetic rubbers. The material, however, must be both resilient and flexible. It is preferred that the connector be of a molded high density polyethylene.

In the embodiment illustrated in FIG. 2, each strut connector 26 is disposed such that an end 38 included on the strut connector is disposed closer to an apex 40 of the kite body 12 than is an end 42 of the strut connector. As will be apparent to those skilled in the art, the strut connector 26 may be disposed such that the end 42 is closer to the apex 40.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention.

What is claimed is:

1. A positionally adjustable strut connector for a kite having a body of flat material symmetrically disposed about a centerline, a pair of diverging wing-struts having first and second ends and being secured to the body on opposite sides of said centerline, and a cross-strut, said positionally adjustable strut connector comprising:

a first body member disposed about a first longitudinal axis, and adapted to receive one of said wing-struts and to be located intermediate said first and second ends of said one wing-strut, said first body member including:

a hollow wing-strut receiving member having a top end and a bottom end; and a second body member disposed about a second longitudinal axis, and adapted to receive one end of said cross-strut, said second body member including:

a cross-strut receiving member including structure defining an open slot having an open first end and a closed second end, and including engaging means for retaining said cross-strut in place, said first end being adapted to receive said one end of said cross-strut, and said second end being disposed proximate said top end of said wing-strut receiving member such that said first and second longitudinal axes are separated by an acute angle; and a hinge member depending from said cross-strut receiving member and extending beyond said second end of said cross-strut receiving member;

wherein said hinge member of said second body member is connected to said wing-strut receiving member of said first body member; and further wherein the angular separation between said first and second longitudinal axes is selectively adjustable.

2. The positionally adjustable strut connector of claim 1 wherein said hinge member is a resilient flexible member.

3. The positionally adjustable strut connector of claim 1 or 2 wherein said hinge member is fixedly connected to said first and second body members.

4. The positionally adjustable strut connector of claim 1 or 2 wherein said hinge connector is an integral part of said first and second body members.

5. The positionally adjustable strut connector of claim 1 or 2 wherein said hinge member is hingedly connected to said first and second body members.

6. The positionally adjustable strut connector of claim 1 wherein said engaging means includes a pair of engaging beads, each of said beads being longitudinally disposed along the inner edge of one side of said open slot.

* * * * *